United States Patent [19]

Volinskie

[11] 4,035,050

[45] July 12, 1977

[54] RIBBON COAXIAL CABLE CONNECTOR

[75] Inventor: Robert Volinskie, Hershey, Pa.

[73] Assignee: AMP Incorporated, Harrisburg, Pa.

[21] Appl. No.: 683,575

[22] Filed: May 5, 1976

[51] Int. Cl.[2] ..... H01R 11/20; H01R 13/46

[52] U.S. Cl. ..... 339/99 R; 339/176 MF

[58] Field of Search ..... 339/17 F, 97 R, 97 P, 339/98, 99, 176 MF

[56] References Cited

U.S. PATENT DOCUMENTS 3,864,011 2/1975 Huber ..... 339/17 F

*Primary Examiner*—Roy Lake

*Assistant Examiner*—Neil Abrams

*Attorney, Agent, or Firm*—Allan B. Osborne

[57] ABSTRACT

This invention relates to a connector for ribbon coaxial cable of the type wherein each center conductor is surrounded by dielectric and a foil shield and each foil shield has a drain wire. More particularly, the connector includes a plurality of contact members each of which consists of an opposing cantilever contact spring section for mating with contact elements of other electrical circuits, a dual-in-line terminating section for receiving either the center conductor or the drain wire and a housing to hold the plurality of contact members.

2 Claims, 7 Drawing Figures

RIBBON COAXIAL CABLE CONNECTOR

BACKGROUND OF THE INVENTION

Miniaturization in the electronic industry placed a large number of discrete signal-receiving devices; e.g., integrated circuit chips, in tiny areas. The diameter of the signal-carrying wires was small enough taken alone, but the number required to connect a printed circuit board having a number of these devices thereon, created a bulky package. Cable consisting of a number of wires joined together by a common outer insulating jacket, called "ribbon cable", provided an initial answer but problems of cross-talk quickly caused workers in the field to seek an improved cable. An early effort resulted in a ribbon cable having a shield wrapped around it, such as disclosed in U.S. Pat. No. 3,634,782. Subsequently U.S. Pat. No. 3,663,739 issued, which taught wrapping a shield around each wire; i.e., around the dielectric surrounding each center conductor. Cross-talk between individual conductors as well as interference to and from the ribbon cable was effectively prevented.

The solving of one problem in this manner however brought about another problem; i.e., the termination of the shield from the cable to the connector. The shields in most common usage consist of a film, such as Mylar, coated with a conductive material. These kinds of shields prohibit all but very careful stripping of the outer insulating jacket. The methods and devices employed to connect the shields to contacts within the connector housing dictated a time-consuming piece-by-piece, hand operation.

Another type of ribbon coaxial cable utilizes a drain wire spirally wrapped about the dielectric surrounding the center conductor. The presence of a drain wire eased considerably the problems of providing a termination. However, the precise location of each spirally-wrapped drain wire on the periphery of the dielectric could not be ascertained prior to stripping the insulation. Further, the location of one drain wire did not necessarily have any relation to the location of the adjacent drain wire. Thus, while the termination was simplified, the unpredictable location of the drain wire stymied mass stripping and gang termination efforts.

These problems led one worker in the field to invent a ribbon coaxial cable of the type having a plurality of parallel center conductors each being surrounded by a dielectric and a foil shield and a drain wire running parallel to the center conductor and in direct contact with the shield. Each drain wire is located in the same angular position on each shield. Rapid and simultaneous stripping and termination was now possible. The aforesaid invention is disclosed in U.S. Pat. No. 3,775,552.

Subsequent to the invention of the ribbon coaxial cable having coplanar drain wires, a connector was invented wherein the housing contained two rows of contact-receiving cavities, one overlapping the other. The lower row of cavities provided contact orientation in a downward direction and the upper row of cavities provided contact oreintation in an upward direction. In use, all center conductors are terminated in contacts in one row and all drain wires terminated in the contacts in the other row. The width of this connector need be basically the same width as the width of the cable even through twice the number of wires were being terminated. This connector is disclosed in U.S. Pat. Nos. 3,864,011 and 3,907,396 and in application Ser. No. 528,294 filed on Nov. 29, 1974 now abandoned; 564,501 filed on Apr. 2, 1975 now abandoned 616,353 filed on Sept. 24, 1975. In conjunction with the aforementioned connector, a crimping tool was invented which has the capability of simultaneously or gang crimping all of the center conductors or all the drain wires in one operation. The connector is loaded into the tool and one set of wires; i.e., all the center conductors or all the drain wires, are fanned into position over the dual wire-in-slot termination ends of the contacts located in one row of cavities. The anvil of the tool presses the set of wires into the slots. The connector is then turned over and the second set of wires are likewise terminated in the contacts in the second row. The rate of termination using this crimping rool, which is disclosed in application Ser. No. 615,273, filed on Sept. 22, 1975, exceeds the rate of termination by other means at least five fold.

Subsequent to the development of the aforementioned inventions, it was found that some applications required a narrow connector but one in which all the contacts were orientated in the same direction.

Accordingly, the object of the present invention is to provide a connector for ribbon coaxial cable in which all the center conductors and all the drain wires of the cable are terminated in contacts orientated in the same direction.

Another object of the present invention is to provide a connector having a width only slightly greater than the width of the ribbon coaxial cable.

Yet another object of the present invention is to provide a connector susceptible to simultaneous or gang termination of all center conductors and all drain wires in a single operation.

These and other objects and advantages of the present invention will become readily apparent upon reading the following description in conjunction with the accompanying drawings.

LISTING OF THE ELEMENTS

Figure 1:
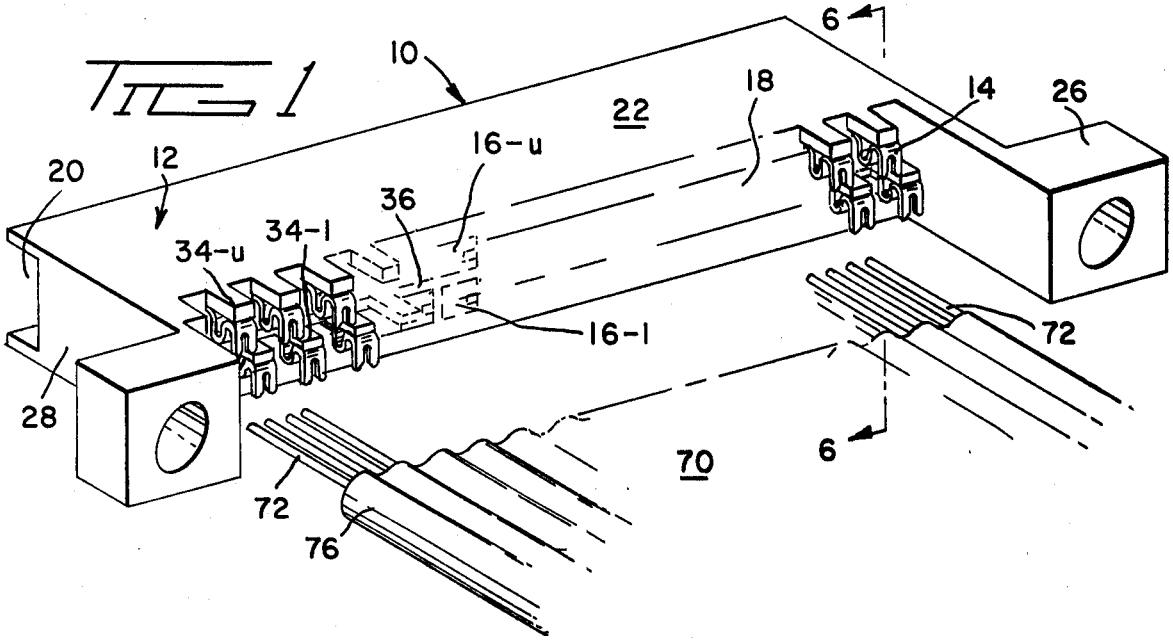
FIG. 1 is a perspective view of a connector constructed in accordance with the preferred embodiment of the present invention.

10 — Connector
12 — Connector housing
14 — Connector contact members Elements of Housing 12:

16 — Passages
18 — Back face
20 — Front face
22 — Top wall
24 — Bottom wall
26 — Mounting ears
28 — Sidewalls
30 — Studs
32 — Rearward opening of passage 16
34 — Support platforms
36 — Separating wall 38 — Upper wall in passage 16
Elements of Contact Members 14:
40 — Terminal section
42 — First wire-receiving slotted blade
44 — Second side
46 — Second wire-receiving slotted blade
48 — Wire-receiving slots
50 — Bight
52 — Contact arm
54 — Intermediate section
56 — First wall
58 — Tine
60 — Second wall
62 — Third wall
64 — Displacement
Elements of Ribbon Coaxial Cable 70:
72 — Signal wires
74 — Drain wires
76 — Outer insulating jacket

DESCRIPTION OF THE PREFERRED EMBODIMENT

Connector 10 as illustrated in FIG. 1 consists of a molded housing 12 and contact members 14.

The significant part of housing 12 contains a plurality of passages 16 arranged in two rows positioned across the breadth of the housing and extending from the transverse back face 18 through to the transverse front face 20. The front face is recessed with respect to the top and bottom walls 22 and 24. This structure however is a conventional "front-end" protective hood feature for multi-contact connectors and should not be considered as part of nor as limiting the present invention. The mounting ears 26 located on both sidewalls 28 are also conventional.

All passages 16 are identical one to the other with each containing on one wall an inwardly projecting stud 30 which provides retention means for the contact members. The lower side of the stud contains a step to provide the contact retaining shoulder 31. This configuration can be seen in FIGS. 6 and 7. These studs are located immediately adjacent to and inwardly from the rearward opening 32 of each passage.

Figure 5:
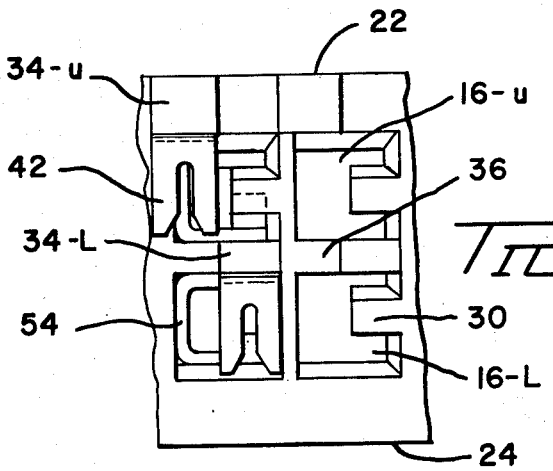
FIG. 5 is an elevational view looking into the back face of the connector of FIG. 1.

As noted above, the several passages are arranged in two rows, one over the other. For convenience, and for a more clear understanding, the passages in the upper row will be referred to as passages 16-U and those in the lower row as passaged 16-L. Overlying each passage 16-U is a rearwardly extending support platform 34-U and overlying each passage 16-L is a rearwardly extending support platform 34-L. While the passages in one row are in direct vertical alignment with the passages in the second row, platforms 34-U are positioned over the left-half of passages 16-U (as one looks into back face 18) and platforms 34-L are positioned over the right-half of passages 16-L. The drawing in FIG. 5 illustrates this laterally-offset pattern.

The differences in thicknesses between the upper and lower support platforms reflect the differences in the thickness of top wall 22 and wall 36 which separates the two rows of passages.

Figure 6:
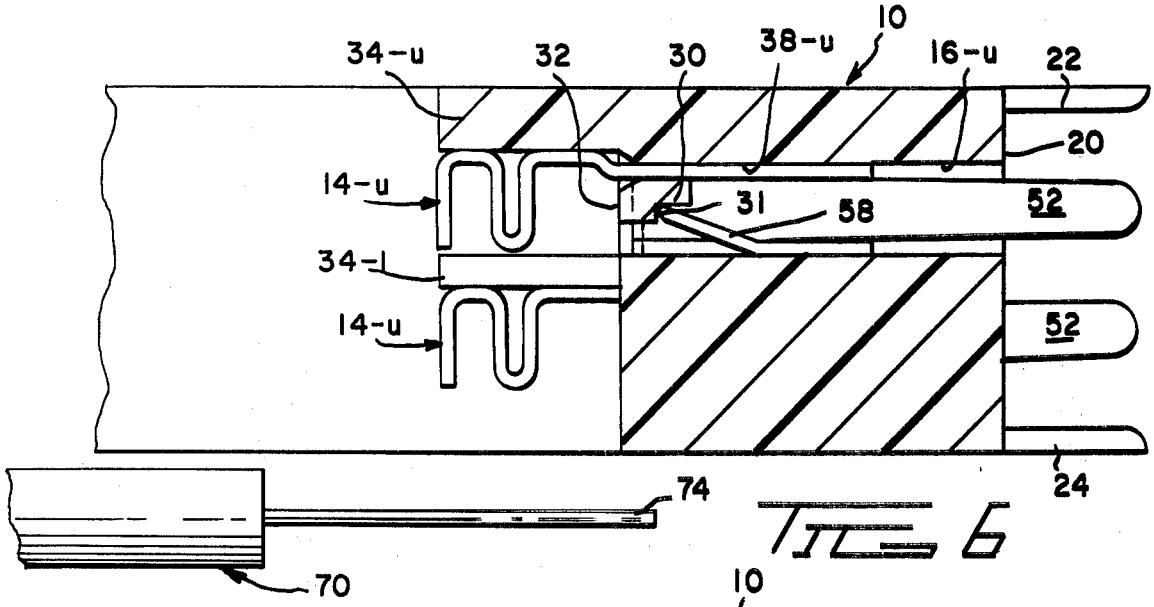
FIGS. 6 and 7 illustrate the method of terminating wires in the connector of FIG. 1 and are taken along lines 6—6 of that figure.

As viewed in FIG. 6, the platform 34-U is displaced with respect to the upper wall 38-U in passage 16-U. Contra, platform 34-L is on the same plane as the corresponding wall in passage 16-L (not shown).

Housing 12 is preferably molded from glass-filled nylon. Other insulating materials can be used provided such material is suitably non-conductive for the current involved.

Figure 2:
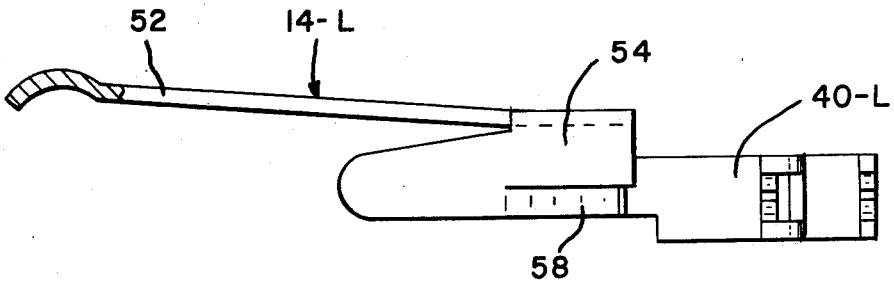
FIGS. 2–4 illustrate the contact members forming part of the connector of FIG. 1.
Figure 3:
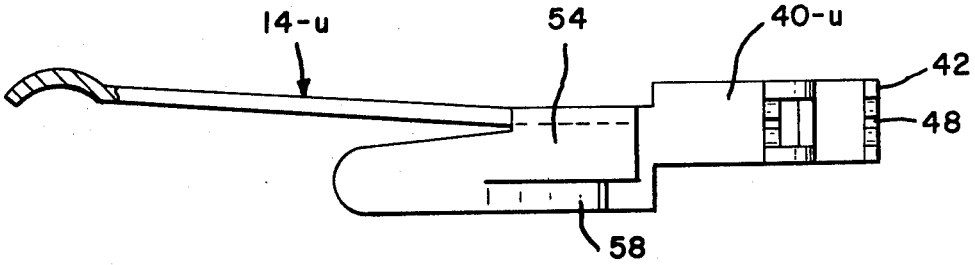
Figure 4:
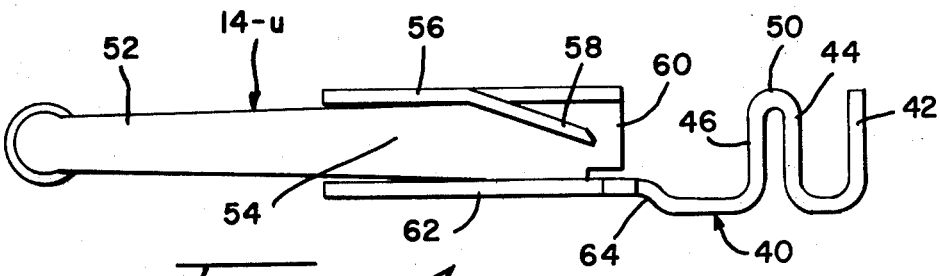

Contact members 14 are illustrated in FIGS. 2, 3 and 4. The member shown in FIG. 2 is received in passages 16-L and are designated as contact member 14-L. Likewise the member shown in FIG. 3 is contact member 14-U and goes into passages 16-U. The difference between the two is that the terminal section 40 on the former is offset to the left (as viewed from the back of the contact member) and the terminal section on the latter is offset to the right.

Terminal section 40 consists of two wire-receiving slotted blades 42 and 46 going from right to left in FIG. 4. Blade 42 is the upturned end of the contact member and contains the conventional wire-receiving slot 48 as can be seen in FIG. 5. Blade 46 is one side of a U-shaped portion in the terminal section. The second side is designated by reference numeral 44. A slot 48 extends down blade 46. A wider slot extends through the bight 50 and second side 44. The wide slot in second side 44 and bight 50 is to provide post clearance during staking of wires into the connector.

In addition to the terminal section, contact member 14 contains a hermaphroditic-type contact arm 52 projecting forwardly. A short third wall intermediate section 54 connects the arm to the terminal section. One wall, designated as first wall 56, carries a tine 58 which points obliquely rearwardly towards terminal section 40. As FIG. 6 shows, this tine catches in shoulder 31 on stud 30 to retain the contact member in the passage. A second wall 60 supports the contact arm 52 is connected to the third wall 62. With respect to contact member 14-U seen in FIG. 4, terminal section 40 has been displaced downwardly as indicated by reference numeral 64. A profile view of contact member 14-L would be the same in all respects except its terminal section would be on the same plane as the wall 62; i.e., it would not be displaced downwardly. With reference to the description of housing 12 above and to FIG. 6, the displacement in contact member 14-U accommodates the displacement of platform 34-U and permits a flush positioning of terminal section 40-U thereon. The displacements in the housing and contact member 14-U were done to maintain a given space between contact arms 52-U and 52-L, maintain a given height of blades 42-U, 44-U and 46-U, and to maintain a given thickness and strength to platform 34-L. Clearly other designs can be developed so as to provide for the aforementioned requirements and the design illustrated should not be taken as limiting the present invention thereto.

It is to be noted that the intermediate section 54 is a relatively short part of the contact member. This short section is an advantage as it reduces signal loss. This positioning of tine 58 on wall 56 rather than wall 60; i.e., the wall from which the contact arm 52 projects, permitted shortening up the section.

It should also be noted that the contact arm 52 and the terminal section 40 are conventional designs. Other contact arm and terminal sections, provided the latter has at least one wire-receiving slotted blade, could be utilized in the practice of the present invention.

Contact members 14 are preferably stamped and formed from mill hardened beryllium copper and plated with gold. Clearly other materials and plating can be used.

FIG. 1 includes a ribbon coaxial cable 70 for which connector 10 was developed. This cable contains a plurality of signal wires 72. Each signal wire is encased first by a dielectric and then a shielding material such as foil. Neither of these components are shown but are well known to those in the art. Each subassembly; i.e., signal wire 72, dielectric and foil, has a drain wire 74 positioned in contact with the foil and running parallel to the signal wire. The location of each drain wire with respect to the signal wire is constant across the cable. A tough outer insulating jacket 76 covers the plurality of subassemblies and drain wires.

Contact members 14 are loaded into housing 12 by placing the contact arm into the passage via rearward opening 32 and shoving on terminal section 40 until tine 58 snaps into shoulder 31 on stud 30. The back of blade 42 will be on line with the end of the platform 34.

Figure 7:
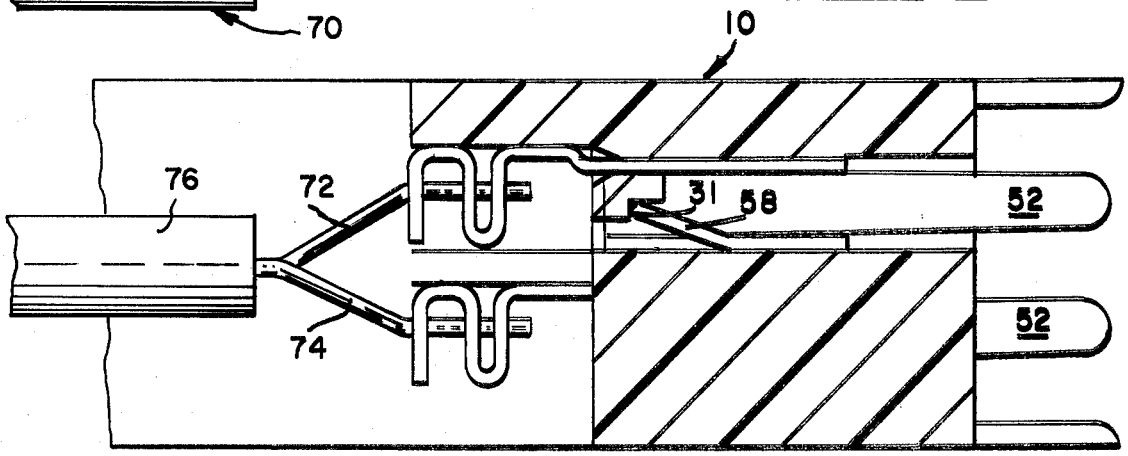

Terminating cable 70 to connector 10 requires stripping the jacket 76, foil and dielectric back to expose a length of the signal and drain wires. The connector, as shown in FIG. 6, is placed in a suitable tool which is not shown herein but is disclosed in U.S. Patent application Ser. No. 683,595, filed concurrently herewith. Its teachings are incorporated herein. The signal and drain wires are laid into a wire support assembly in the tool and the connector, held in a connector support assembly on the movable member, is brought down thereagainst. The wire-receiving slotted blades slide down into openings or spaces across which the wires are laid. One set of wires; i.e., either all the signal wires or all the drain wires, being staked into the lower contact members are free to be pushed down into slots until they are stopped by the bases of the slots. Thereafter, continued descent of contact members 14-L forces the wires into slots 48. Concurrently the other set of wires are supported by a plurality of posts and are forced into the slots in the blades on contact members 14-U. The result is shown in FIG. 7. The support platforms 34 provide means against which the tool can press in the staking function.

The foregoing detailed description has been given for clearness of understanding only, and no unnecessary limitations should be understood therefrom, as some modifications will be obvious to those skilled in the art.

What is claimed is:

1. An electrical connector for a plurality of wires, which comprises:

a. an insulating housing having two rows of passages extending therethrough, one row overlying the other with each passage in the upper row being in direct alignment with a passage in the lower row, and further a platform extending outwardly from an edge defining an end face of each passage with the platforms in the upper row being laterally offset relative to the platforms in the lower row; and b. a plurality of conductive contact members position in said passages, each contact member having on one end a terminal section projecting outward from an end face of the passages, said terminal sections in the upper row being laterally offset relative to the terminal sections in the lower row so that the base of each terminal section is in direct and abutting alignment with a platform, further each terminal section having on the surface opposite the base wire-receiving means for receiving and electrically terminating a wire, said wire-receiving means on all the terminal sections being oriented in the same direction.

2. A housing for a plurality of electrical contacts of the type having terminal sections on one end with open slot wire-receiving means on one surface thereof, further, the terminal sections on one half of the plurality of contacts being laterally offset to the left with respect to the contacts other end and the terminal sections on the other half of the plurality of contacts being laterally offset to the right, said housing comprising, a rectangular block of insulating material with a plurality of passages therethrough for receiving the electrical contacts with the terminal section extending outwardly therefrom, said passages being arranged in an upper and lower row with each passage in one row being in direct vertical alignment with a passage in the other row, further said block having a plurality of platforms extending longitudinally from one horizontal edge of each passage, the platforms associated with the passage in one row being laterally offset towards one vertical edge thereof and the platforms associated with the passages in the other row being laterally offset toward the other vertical edge so that upon inserting the electrical contacts into the passages the base of the laterally offset terminal sections are in alignment with and abut the platforms and the open slot wire-receiving means on the terminal sections face away from the platforms.

* * * * *